US009784020B2

(12) United States Patent
Kwon et al.

(10) Patent No.: US 9,784,020 B2
(45) Date of Patent: Oct. 10, 2017

(54) OPENING AND CLOSING APPARATUS OF ENGINE ROOM FOR VEHICLE

(71) Applicant: Hyundai Motor Company, Seoul (KR)

(72) Inventors: Ho Kyeong Kwon, Seoul (KR); Dong Hyun Lee, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 339 days.

(21) Appl. No.: 14/525,094

(22) Filed: Oct. 27, 2014

(65) Prior Publication Data

US 2015/0345187 A1 Dec. 3, 2015

(30) Foreign Application Priority Data

Jun. 3, 2014 (KR) ..... 10-2014-0067878

(51) Int. Cl.

*E05C 3/16* (2006.01)
*E05B 83/24* (2014.01)
*E05C 3/00* (2006.01)

(52) U.S. Cl.

CPC ..... *E05B 83/24* (2013.01); *Y10S 292/37* (2013.01); *Y10S 292/42* (2013.01); *Y10T 292/0848* (2015.04)

(58) Field of Classification Search

CPC ..... Y10S 292/37; Y10S 292/42; E05B 83/24
USPC ..... 292/98, 170, 197, 224, 230; 180/69.21
See application file for complete search history.

(56) References Cited

U.S. PATENT DOCUMENTS 1,257,998 A * 3/1918 Gruber ..... E05C 1/14 292/170
1,556,864 A * 10/1925 Mendenhall ..... E05B 83/247 292/33
4,875,724 A * 10/1989 Gruber ..... E05B 83/16 292/216
4,936,611 A * 6/1990 Palvolgyi ..... E05B 83/16 292/216
5,348,355 A * 9/1994 Oyha ..... E05B 83/16 292/11
5,445,421 A * 8/1995 Ferrara ..... E05B 83/24 292/216
5,618,069 A * 4/1997 Konchan ..... E05B 17/007 292/216

(Continued)

FOREIGN PATENT DOCUMENTS

JP 2004-036221 A 2/2004
KR 1998-018829 U 7/1998

(Continued)

*Primary Examiner* — Carlos Lugo
(74) *Attorney, Agent, or Firm* — Morgan Lewis & Bockius LLP

(57) ABSTRACT

An opening and closing apparatus of an engine room for a vehicle may include a striker configured to be disposed in a vehicle hood, a push button configured to be disposed in front of the vehicle, a base, a first latch configured to be coupled with a front portion of the base, a push rod configured to press the first inclined surface of the first latch by operating the push button. a support plate configured to be disposed at a rear portion of the base, a second latch configured to be disposed between the base and the support plate, and a pawl configured to be disposed between the base and the support plate and formed to be coupled or decoupled with or from the second latch.

7 Claims, 6 Drawing Sheets

(56) References Cited

U.S. PATENT DOCUMENTS

| | | | | | |
|---|---|---|---|---|---|
| 5,626,374 | A * | 5/1997 | Kim | E05C 1/145 | 292/137 |
| 5,738,393 | A * | 4/1998 | Chao | E05B 83/24 | 292/216 |
| 5,853,060 | A * | 12/1998 | Chao | E05B 83/16 | 180/289 |
| 6,280,592 | B1 * | 8/2001 | Mastrofrancesco | E05B 15/16 | 204/485 |
| 6,422,616 | B1 * | 7/2002 | Wortmann | E05B 83/24 | 292/214 |
| 6,471,263 | B1 * | 10/2002 | Choo | B60J 1/1884 | 292/336.3 |
| 6,485,071 | B2 * | 11/2002 | Schwaiger | E05B 83/16 | 292/216 |
| 6,666,483 | B2 * | 12/2003 | Baniak | E05B 83/24 | 292/123 |
| 7,261,337 | B2 * | 8/2007 | Nakagome | E05B 83/24 | 292/216 |
| 8,573,658 | B2 * | 11/2013 | Kim | B60R 21/34 | 292/201 |
| 2006/0170224 | A1 * | 8/2006 | Mitchell | E05B 77/04 | 292/216 |

FOREIGN PATENT DOCUMENTS

| | | | |
|---|---|---|---|
| KR | 20-0173207 | Y1 | 12/1999 |
| KR | 10-2006-0004177 | A | 1/2006 |
| KR | 10-0836983 | B1 | 6/2008 |
| KR | 1020100048356 | A | 5/2010 |
| KR | 1020110012903 | A | 2/2011 |

* cited by examiner

OPENING AND CLOSING APPARATUS OF ENGINE ROOM FOR VEHICLE

CROSS REFERENCE TO RELATED APPLICATION

The present application claims priority of Korean Patent Application Number 10-2014-0067878 filed on Jun. 3, 2014, the entire contents of which application are incorporated herein for all purposes by this reference.

BACKGROUND OF THE INVENTION

Field of the Invention

The present invention relates to an opening and closing apparatus of an engine room for a vehicle which is associated with a hood for opening and closing the engine room for a vehicle and a striker and a latch formed in a vehicle body.

Description of Related Art

Generally, an engine room and a trunk room for a vehicle are provided with hoods to open or close them from the outside. The hoods are configured to be opened and closed by rotating upwardly based on a hinge while being hinged to a portion of a vehicle body. Among those, in particular, a front hood to open and close the engine room is configured to be primarily opened by an operating switch, and the like at a driver's seat of a vehicle and then secondarily opened by putting a hand in a gap between a hood panel and a radiator grill in front of the vehicle to operate a lever. Therefore, the front hood is locked or unlocked by the striker at the hood panel side and the latch at the vehicle body.

However, the related art which opens the front hood by directly putting the user's hand in the gap between the hood panel and the radiator as described above has a problem in that the user's hand is damaged, it is difficult to find out the lever, an available space to avoid interference between the levers is required, and the like.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an opening and closing apparatus of an engine room for a vehicle capable of solving a problem in that a user's body is polluted or damaged, it is difficult to find out a lever, an available space to avoid interference between levers of a hood at the time of a design is secured, and the like.

According to an aspect of the present invention, there is provided an opening and closing apparatus of an engine room for a vehicle including, a striker configured to be disposed in a vehicle hood. a push button configured to be disposed in front of the vehicle. a base configured to be formed in a plate shape to be provided with a first coupling groove indented downwardly from an upper end. a first latch configured to have a hook-shaped hooker formed at an upper end thereof and be coupled with a front portion of the base, provided with a first inclined surface forwardly protruding, and slidably provided. a push rod configured to be formed in a bar shape, extend toward a rear portion of the push button, and have a second inclined surface at a position corresponding to the first inclined surface formed at a rear end thereof to press the first inclined surface of the first latch by operating the push button. a support plate configured to be disposed at a rear portion of the base, provided with a second coupling groove at a position corresponding to the first coupling groove, and spaced apart from the base by a predetermined distance. a second latch configured to be disposed between the base and the support plate, rotate based on a first rotating shaft, and have one portion provided with a third coupling groove which is formed to be coupled or decoupled with or from the striker and another portion provided with a coupling part. A pawl configured to be disposed between the base and the support plate and have one portion coupled therewith by having a second rotating shaft penetrated therethrough and other portion rotatably formed based on the second rotating shaft, and formed to be coupled or decoupled with or from the second latch.

An outside of the push rod may be provided with a guide which encloses the outside of the push rod and has a rear end having an opened shape and the push rod may be slid back and forth within the guide.

One side of the guide may be provided with a guide groove along a longitudinal direction of the push rod.

An outside of a front portion of the guide may be provided with a protrusion protruding to the outside, a rear end of the push rod may be provided with a protrusion protruding to the outside, and the protruding protrusion of the guide may be connected with the protruding protrusion of the push rod by a first elastic member to make the push rod elastically slide at the time of operating the push button.

A lower end of the base may be provided with a slit hole horizontally elongated and the first latch may be pin-coupled with the base by a pin penetrating through the slit hole and is slid horizontally.

A side of the first latch may be provided with a second elastic member of which one end is coupled with the first latch and another end is coupled with the base to be slid horizontally along the slit hole by operating the push button.

The coupling part of the second latch may be provided with a third elastic member of which one portion is coupled with the base and another portion is coupled with the second latch.

The pawl may be provided with a fourth elastic member of which one end is coupled with the pawl and another end is coupled with the base to elastically rotate the pawl 1 and then be originally recovered.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
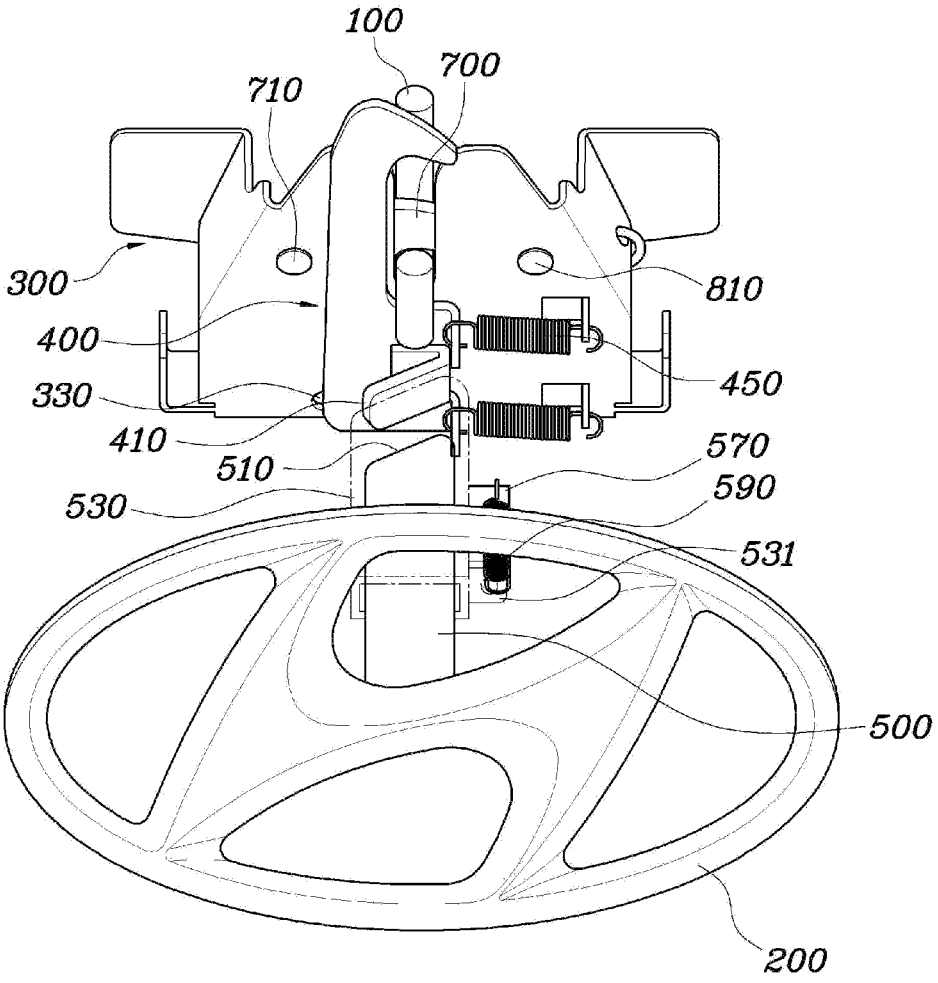
FIG. 1 is a diagram illustrating an opening and closing apparatus of an engine room for a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, an opening and closing apparatus of an engine room for a vehicle according to exemplary embodiments of the present invention will be described with reference to the accompanying drawings.

Figure 2:
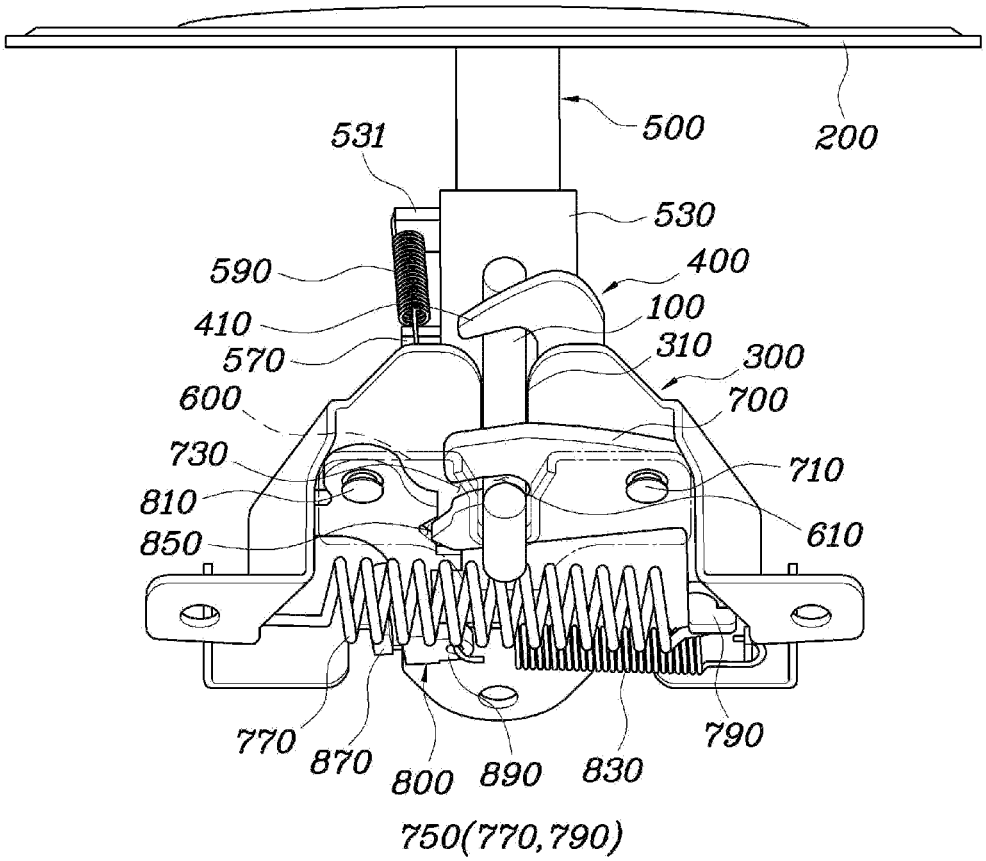
FIG. 2 is a diagram illustrating a rear side of FIG. 1.
Figure 3:
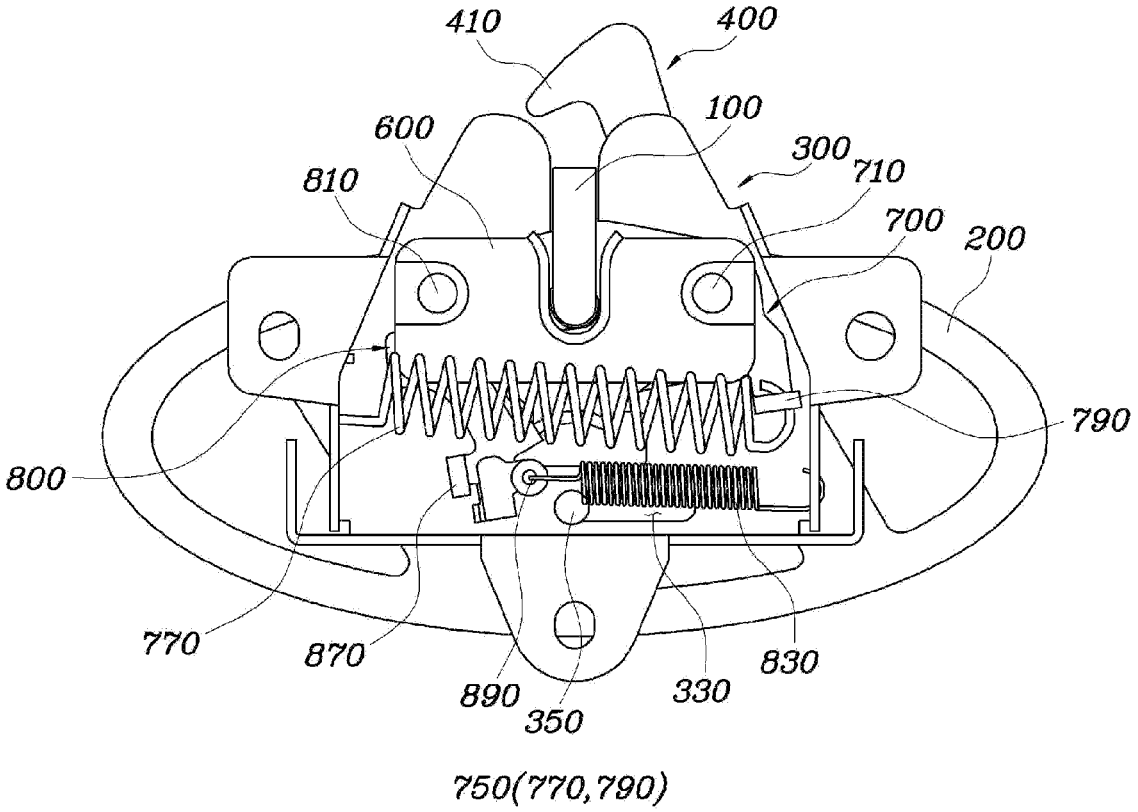
FIG. 3 is a rear view of FIG. 1.
Figure 4:
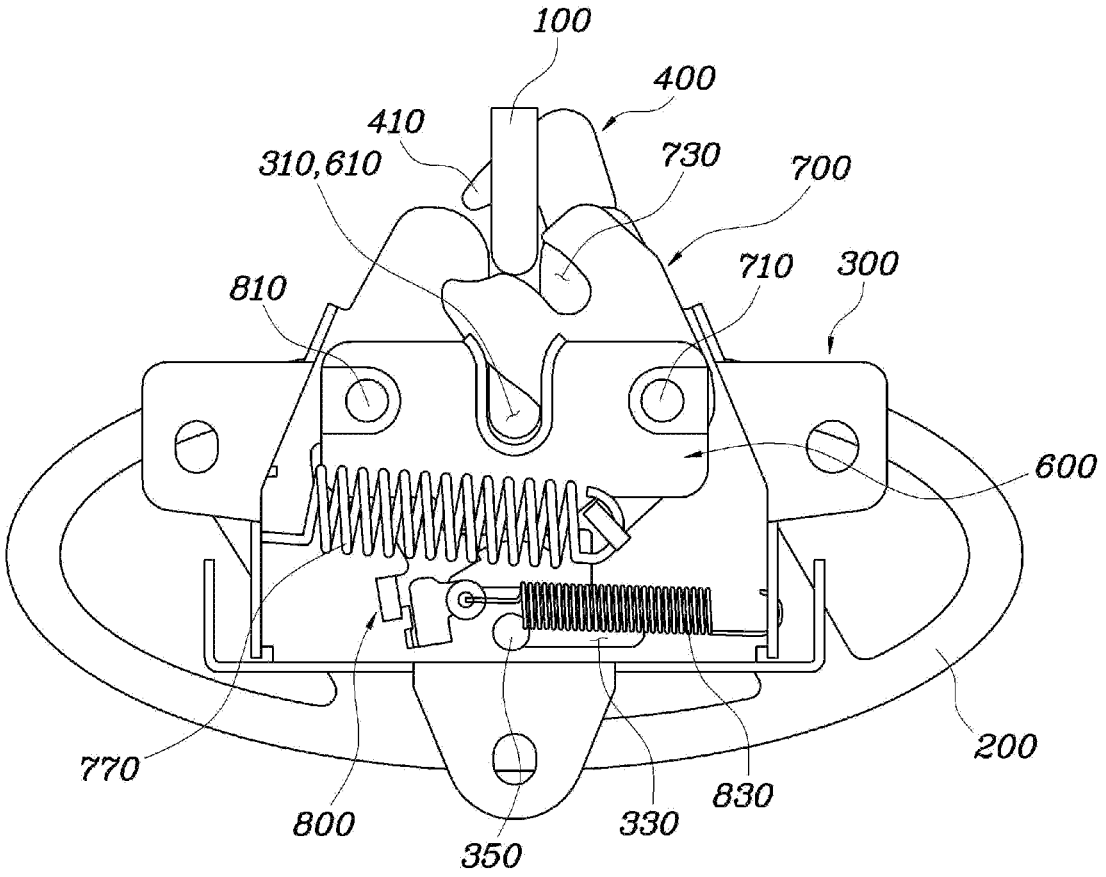
FIG. 4 is a diagram illustrating a primary opening state of FIG. 1.
Figure 5:
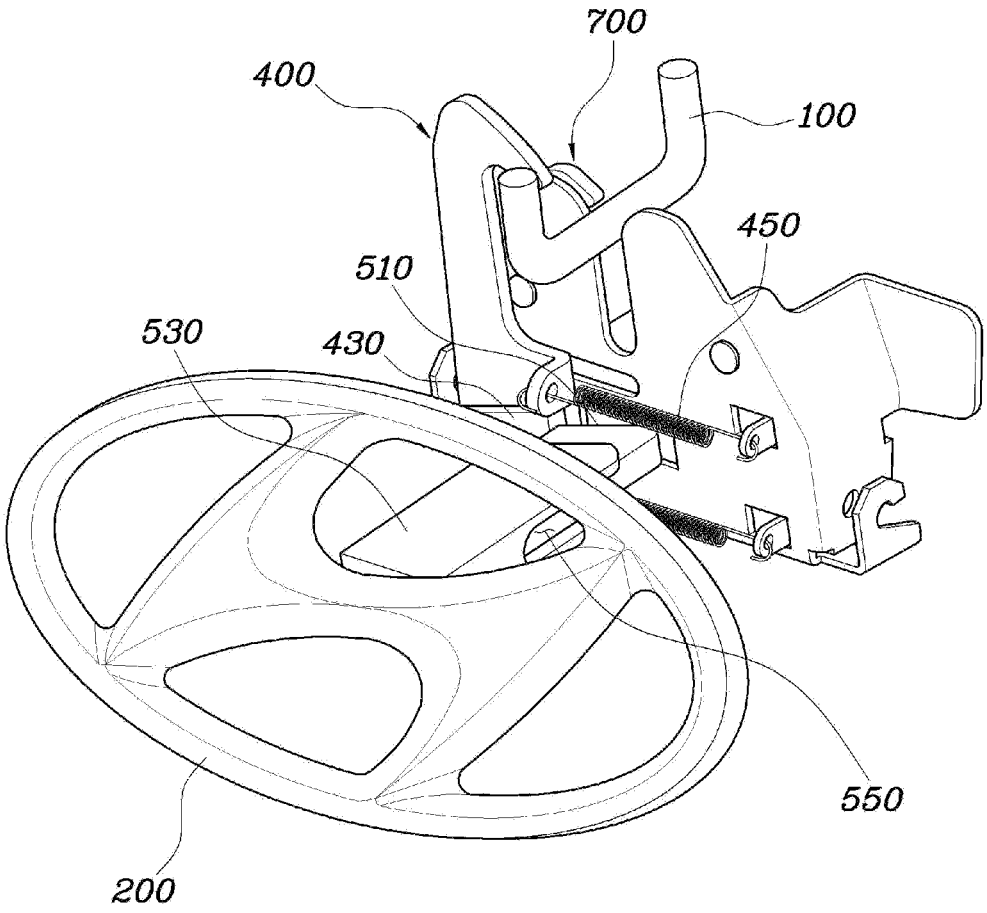
FIG. 5 is a diagram illustrating a state in which a push button of FIG. 1 is pressed.
Figure 6:
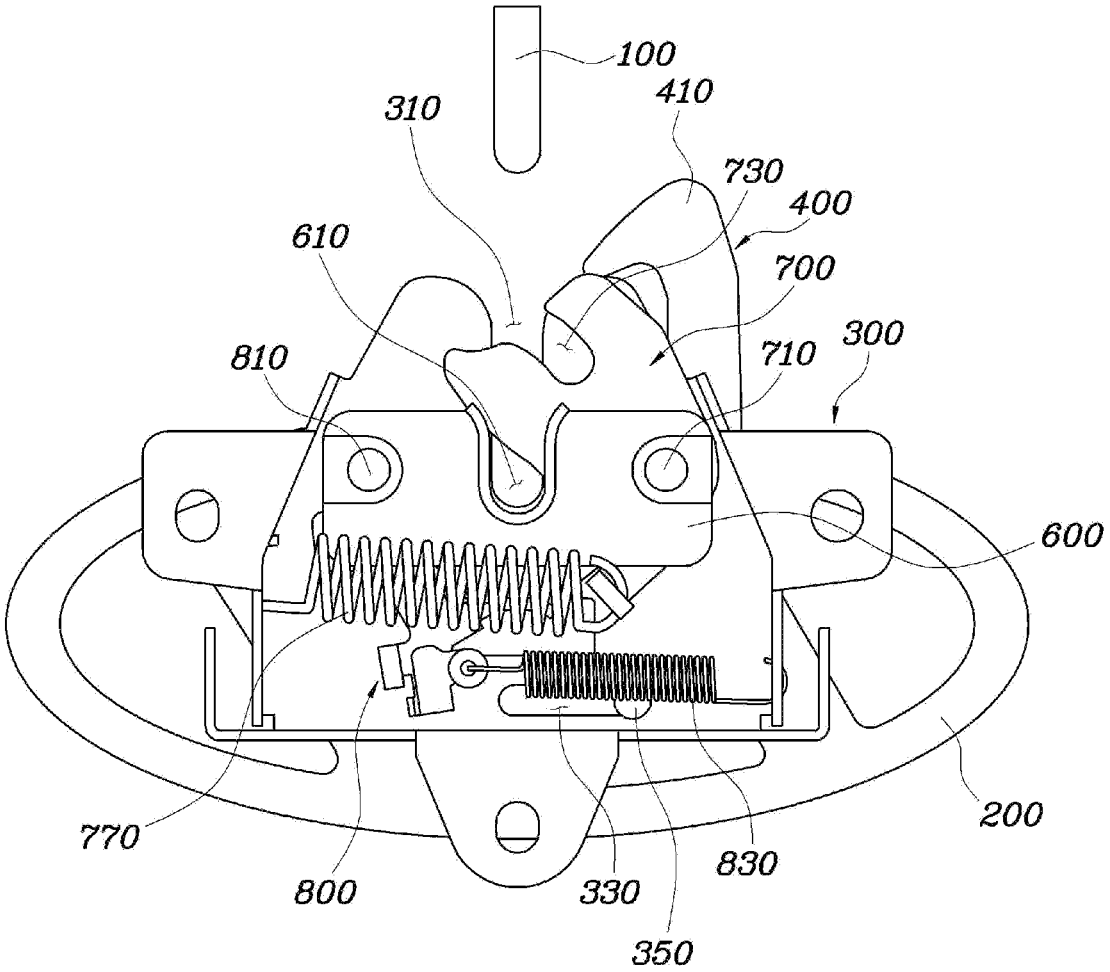
FIG. 6 is a diagram illustrating a secondary final opening (pressing) state of FIG. 1.

FIG. 1 is a diagram illustrating an opening and closing apparatus of an engine room for a vehicle according to an exemplary embodiment of the present invention, FIG. 2 is a diagram illustrating a rear side of FIG. 1, and FIG. 3 is a rear view of FIG. 1. Further, reviewing the drawings according to an operation, FIG. 4 is a diagram illustrating a primary opening state of FIG. 1, FIG. 5 is a diagram illustrating a state in which a push button of FIG. 1 is pressed, and FIG. 6 is a diagram illustrating a secondary final opening (pressing) state of FIG. 1.

An opening and closing apparatus of an engine room for a vehicle according to the exemplary embodiment of the present invention includes, a striker 100 configured to be disposed in a vehicle hood panel. a push button 200 configured to be disposed in front of the vehicle. a base 300 configured to be formed in a plate shape to be provided with a first coupling groove 310 indented downwardly from an upper end. a first latch 400 configured to have a hook-shaped hooker 410 formed at an upper end thereof and be coupled with a front portion of the base 300, provided with a first inclined surface 430 forwardly protruding, and slidably provided. a push rod 500 configured to be formed in a bar shape, extend toward a rear portion of the push button 200, and have a second inclined surface 510 at a position corresponding to the first inclined surface 430 formed at a rear end thereof to press the first inclined surface 430 of the first latch 400 by operating the push button 200. a support plate 600 configured to be disposed at a rear portion of the base 300, provided with a second coupling groove 610 at a position corresponding to the first coupling groove 310, and spaced apart from the base 300 by a predetermined distance. a second latch 700 configured to be disposed between the base 300 and the support plate 600, rotates based on a first rotating shaft 710, and have one portion provided with a third coupling groove 730 which is formed to be coupled or decoupled with or from the striker 100 and another portion provided with a coupling part 750. a pawl 800 configured to be disposed between the base 300 and the support plate 600 and have one portion coupled therewith by having a second rotating shaft 810 penetrated therethrough and other portion rotatably formed based on the second rotating shaft 810, and formed to be coupled or decoupled with or from the second latch 700.

The opening and closing apparatus of an engine room for a vehicle is primarily unlocked by a switch, and the like inside a vehicle in order for a user to open a hood panel of an engine room and then secondarily unlocked by a lever outside the vehicle. Therefore, the opening and closing apparatus of an engine room for a vehicle has a structure which is primarily unlocked and a structure which is secondarily unlocked. First, the structure and operation which are primarily unlocked will be described.

The plate-shaped base 300 which is coupled with a vehicle body is provided and is provided with the first coupling groove 310 indented downwardly from the upper end and the inside of the vehicle may be formed with a predetermined space. The space is provided with the pawl 800 and the second latch 700 which contact each other. A disposition of each component may be changed without limitation according to a design or environment. According to the exemplary embodiment of the present invention, the state in which the second latch 700 is disposed at the right and the pawl 800 is coupled with the left will be illustrated and described by way of example.

The second latch 700 has a plate shape and is coupled with the base 300 by the first rotating shaft 710 and one portion thereof is provided with the third coupling groove 730 which is opened toward the first coupling groove 310. Another portion of the second latch 700, that is, in the exemplary embodiment of the present invention, a right lower end is provided with the coupling part 750, in which the coupling part is configured of a protruding coupling protrusion 790 and a third elastic member 770. One portion of the third elastic member 770 is coupled with the base 300 and another portion thereof is coupled with the second latch 700. Therefore, the second latch 700 has a force always rotating clockwise by the third elastic member 770.

The left of the second latch 700 is provided with the pawl 800 having the plate shape which is vertically elongated. A portion of the pawl 1 800 contacting the second latch 700 is provided with a hooking groove 850. One portion of the pawl 800 is rotatably coupled with the base 300 by having the second rotating shaft 810 penetrated therethrough and another portion thereof is formed to rotate based on the second rotating shaft 810. Another portion of the pawl 800 is coupled with a fixing part 870 which is connected with an indoor switch and a fourth elastic member 830 of which one end is coupled with the pawl 800 and another end is coupled with the base 300 so that the pawl 800 may elastically rotate and then may be originally recovered and has a force always rotating counterclockwise. Therefore, the hooking groove 850 of the pawl 800 is hooked with an end of the second latch 700 to prevent the second latch 700 from rotating clockwise at ordinary times.

Therefore, when a user presses the switch to open the hood panel inside the vehicle, a wire connected to the fixing part 870 of the pawl 800 is pulled to the left. Therefore, the pawl 800 overcomes the force of the fourth elastic member 830 to rotate clockwise. When the pawl 800 rotates clockwise, the second latch 700 is separated from the hooking groove 850 of the pawl 800 and the second latch 700 rotates clockwise by an elastic force of the third elastic member 770.

Consequently, as illustrated in FIG. 4, the striker 100 is separated from the third coupling groove 730 of the second latch 700. However, a force to pull the wire by having the user press the switch is a one-time event and therefore after the striker 100 is separated from the second latch 700, the pawl 800 again rotates counterclockwise by the elastic force of the fourth elastic member 830 and thus is recovered to an original position. However, the second latch 700 is kept while being separated from the hooking groove 850.

Further, the rear portion of the base 300, the pawl 800, and the second latch 700 is provided with the support plate 600 which has a plate shape and is provided with the second coupling groove 610 at the position corresponding to the first coupling groove 310 of the base 300. The support plate 600 is disposed at a position spaced apart from the base 300 by a predetermined distance. The support plate 600 prevents the pawl 800 and the second latch 700 from separating from the base 300 at the time of the operation of the pawl 800 and the second latch 700. Further, the support plate 600 serves to prevent an over slam of the pawl 800 and the second latch 700 and set a rotating reference angle of the pawl 800. The support plate 600 is coupled with the base 300 by having the first rotating shaft 710 and the second rotating shaft 810 penetrated through both sides thereof.

As described above, after the primary unlocking, the striker 100 is separated from the second latch 700 but is not completely separated therefrom, and therefore the user needs to open the hood panel of the engine room at the outside of the vehicle. According to the related art, the lever and the like is used, but according to the exemplary embodiment of the present invention, the user presses the separately formed push button 200 even though he/she does not directly put in the gap between the hood panel and the radiator, thereby opening the hood panel. Therefore, the state in which after the primary unlocking, the hood panel of the engine room is completely opened will be described below.

FIG. 5 is a diagram illustrating the state in which the push button 200 is being pressed, in which a front upper end of the base 300 is provided with the hook-shaped hooker 410 and the front portion of the base 300 is provided with the first latch 400. The first latch 400 is provided with the first inclined surface 430 forwardly protruding and the first latch 400 may be slidably provided horizontally. The first inclined surface 410 may be formed to rise from the left toward the right. Further, the first latch 400 and the second latch 700 are opened in the same direction and thus the striker 100 may be hooked to the opened hooker 410 and the third coupling groove 730.

A lower end of the base 300 is provided with a slit hole 330 which is elongated horizontally and the first latch 400 may be pin-coupled with the base 300 by having a pin 350 penetrated through the slit hole 300. Therefore, the pin 350 is slid within the slit hole 330 and thus the first latch 400 may be slid horizontally.

Further, a side of the first latch 400 may be coupled with the second elastic member 450 of which one end is coupled with the first latch 400 and another end is coupled with the base 300. Therefore, when the push button 200 is pressed, the second inclined surface 510 of the push rod 500 may press the first inclined surface 430 of the first latch 400 and the first latch 400 may be slid horizontally along the slit hole 330. Herein, to more stably operate the opening and closing apparatus of an engine room for a vehicle, the slit hole 330 and the second elastic member 450 may be disposed in plural at a predetermined interval. The push button 200 may be disposed in front of the vehicle and may be separately formed, but according to the exemplary embodiment of the present invention, the case in which an emblem of the vehicle is used as the push button 200 is described by way of example.

The push button 200 is provided with the push rod 500 which has a bar shape and extends to the rear portion of the push button 200 and has a rear end provided with the second inclined surface 510 at the position corresponding to the first inclined surface 430. The push rod 500 presses the first inclined surface 410 of the first latch 400 by operating the push button 200.

Further, the end of the push rod 500 and the first latch 400 are formed to be spaced apart from each other by a predetermined interval. Therefore, when the user presses the push button 200, the push button 200 and the push rod 500 are advanced toward the rear portion of the vehicle and the second inclined surface 510 of the push rod 500 contacts the first inclined surface 430 of the first latch 400. In this state, when the push button 200 is more pressed, the second inclined surface 510 is slid by the force pressing the first inclined surface 430 and thus the first latch 400 is slid to the left according to the shape of the first inclined surface 430, such that the hooker 410 of the first latch 400 is completely separated from the striker 100.

The outside of the push rod 500 is provided with a guide 530 having a shape enclosing the outside of the push rod 500. The push rod 500 moves back and forth within the guide 530 and the rear end of the guide 530 is opened, such that the push rod 500 is formed to be separated from the guide 530 to press the first latch 400. Further, one side of the guide 530 is provided with a guide groove 550 in a longitudinal direction of the push rod 500.

The outside of the front end of the guide 530 is provided with a protruding protrusion 531 and the rear end of the push rod 500 is provided with a protrusion 570 which protrudes to the outside. The protruding protrusion 531 of the guide is connected with the protruding protrusion 570 of the push rod by a first elastic member 590 Therefore, at the time of the operation of the push button 200, the push rod 500 is elastically slid toward the rear portion of the vehicle within the guide 530 (FIG. 6) and at the time of depressing the push button 200, the push button 200 is recovered to an original position by the first elastic member 590.

According to the opening and closing apparatus of an engine room for a vehicle according to the exemplary embodiments of the present invention, the levers of the hood panel may be removed and thus the separate space for preventing the interference of the levers may be removed to improve the difficulty in securing the space between the hood panel and the front end module (FEM) due to the security of the downward and cooling area of the hood panel, thereby effectively using the space between the hood panel and the FEM. Therefore, the related art needs to reduce the cross sectional area of the hood panel to secure the available space for preventing the interference between the levers of the rotating lever type, but according to the exemplary embodiments of the present invention, since the available space may be removed and thus there is no need to reduce the cross sectional area of the hood panel, such that the rigidity may be increased and the available space may be secured at the time of collision, thereby providing the safer vehicle to the user.

In addition, according to the exemplary embodiments of the present invention, it is possible to solve the problem in that the components may be stuck or corroded due to the accumulation of the impurities such as dust in the rotating part which is the chronic problem of the rotating lever type according to the related art and thus may be out of order and since there is no need to directly put the hand in the gap between the hood panel and the radiator grill, the user may be protected from the damage, pollution, or the like of the user's hand to increase the user convenience, thereby increasing the satisfaction of the user and promoting the brand image.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An opening and closing apparatus of an engine room for a vehicle, comprising:

a striker configured to be disposed in a vehicle hood;

a push button configured to be disposed in front of the vehicle;

a base configured to be formed in a plate shape to be provided with a first coupling groove indented downwardly from an upper end thereof;

a first latch configured to have a hook-shaped hooker formed at an upper end thereof and be coupled with a front portion of the base, provided with a first inclined surface forwardly protruding, and slidably provided to be operated by the push button;

a push rod configured to be formed in a bar shape, extend toward a rear portion of the push button, and have a second inclined surface at a position corresponding to the first inclined surface formed at a rear end thereof to press the first inclined surface of the first latch by operating the push button;

a support plate configured to be disposed at a rear portion of the base, provided with a second coupling groove at a position corresponding to the first coupling groove, and spaced apart from the base by a predetermined distance;

a second latch configured to be disposed between the base and the support plate, rotate based on a first rotating shaft, and have one portion provided with a third coupling groove which is formed to be coupled or decoupled with or from the striker and another portion provided with a coupling part; and a pawl configured to be disposed between the base and the support plate and have one portion coupled therewith by having a second rotating shaft penetrated therethrough and another portion rotatably formed based on the second rotating shaft, and formed to be coupled or decoupled with or from the second latch, wherein a lower end of the base is provided with a slit hole horizontally elongated and the first latch is pin-coupled with the base by a pin penetrating through the slit hole and is slid horizontally.

2. The opening and closing apparatus of claim 1, wherein an outside of the push rod is provided with a guide which encloses the outside of the push rod and has a rear end having an opened shape and the push rod is slid back and forth within the guide.

3. The opening and closing apparatus of claim 2, wherein one side of the guide is provided with a guide groove along a longitudinal direction of the push rod.

4. The opening and closing apparatus of claim 2, wherein an outside of a front portion of the guide is provided with a protrusion protruding to the outside and a rear end of the push rod is provided with a protrusion protruding to the outside and the protruding protrusion of the guide is connected with the protruding protrusion of the push rod by a first elastic member to make the push rod elastically slide at a time of operating the push button.

5. The opening and closing apparatus of claim 4, wherein a side of the first latch is provided with a second elastic member of which one end is coupled with the first latch and another end is coupled with the base to be slid horizontally along the slit hole by operating the push button.

6. The opening and closing apparatus of claim 5, wherein the coupling part of the second latch is provided with a third elastic member of which one portion is coupled with the base and another portion is coupled with the second latch.

7. The opening and closing apparatus of claim 6, wherein the pawl is provided with a fourth elastic member of which one end is coupled with the pawl and another end is coupled with the base to elastically rotate the pawl and then be originally recovered.

* * * * *